United States Patent [19]

Kosugi et al.

[11] Patent Number: 4,641,904

[45] Date of Patent: Feb. 10, 1987

[54] FLAT CABLE CONNECTING SYSTEM

[75] Inventors: Motoki Kosugi; Hidetaka Nakano, both of Tokyo, Japan

[73] Assignee: Yamaichi Electric Mfg. Co., Ltd., Tokyo, Japan

[21] Appl. No.: 620,075

[22] Filed: Jun. 12, 1984

[30] Foreign Application Priority Data

Nov. 9, 1983 [JP] Japan ..... 58-210579
Jun. 18, 1984 [JP] Japan ..... 58-109699

[51] Int. Cl.[4] ..... H01R 11/20

[52] U.S. Cl. ..... 339/99 R; 339/17 F; 339/14 R

[58] Field of Search ..... 339/14 R, 17 F, 97 R, 339/97 P, 99 R, 176 MF

[56] References Cited

U.S. PATENT DOCUMENTS 3,149,896 9/1964 Hall ..... 339/17 F
4,095,862 6/1978 Hatch ..... 339/14 R
4,152,826 5/1979 Mueller ..... 339/17 F
4,181,384 1/1980 Dola et al. ..... 339/14 R
4,359,257 11/1982 Lopinski et al. ..... 339/99 R
4,521,969 6/1985 Greenwood ..... 339/17 F

*Primary Examiner*—Gil Weidenfeld
*Assistant Examiner*—Paula A. Austin
*Attorney, Agent, or Firm*—Wenderoth, Lind & Ponack

[57] ABSTRACT

In a flat cable connecting system comprising pinching a multiple core flat cable between a connector cover and a connector substrate having contacts to cause the contacts to pierce through an insulator of the multiple core flat cable and, in conjunction therewith, to catch hold of and electrically connect conductors within the insulator of the multiple core flat cable, the improvement comprises forming in the insulator perforations for dividing the conductors into conductor segments extending in one direction and conductor segments extending in the other direction, and causing different signal contacts of the connector substrate to catch hold of and electrically connect the respective conductor segments at their terminals on the perforation sides, thereby forming different signal lines with the perforations as boundaries.

14 Claims, 25 Drawing Figures

FLAT CABLE CONNECTING SYSTEM

BACKGROUND OF THE INVENTION

1. Field of the Invention:

The present invention relates to a system for the connection of a multiple core flat cable to which a connector having a plurality of contacts is attached so that the contacts may pierce through an insulator of the flat cable to catch hold of and connect to the conductors in the insulator.

2. Description of the Prior Art:

The term "multiple core flat cable" used throughout the specification means a cable having a number of parallel conductors coated with a strap of insulator and having a flat portion formed on at least part of the entire length thereof and includes, for example, ribbon-shaped flat cables each having a plurality of conductors arranged in parallel and coated with a strap of insulator over the entire length thereof and twisted flat cables each comprising a number of twisted conductor pairs arranged in series and having an insulated connector-fitting area to be subjected to electrical connection after each conductor pair has been untwisted so as to be aligned in parallel. The multiple core flat cable finds wide acceptance in forming a number of signal lines by connecting its conductors one each to contacts of a connector.

It has been known that the construction of a number of conductors of a flat cable composed of those for signals and those for grounding being alternately arranged adjacent to each other can prevent electrical interference between the conductors for signals, i.e. cross talk, and can therefore make electrical transmission characteristics of the conductors for signals good. When a flat cable has conductors for grounding and conductors for signals arranged alternately, as described above, the number of the conductors for signals is one half the entire number of the conductors of the flat cable. Therefore, in order to secure both the conductors for grounding serving to prevent the aforementioned cross talk and the number of conductors for signals corresponding to the entire number of conductors in one strap of flat cable, it has been required to prepare two straps of flat cables and to provide individual connection mechanisms and connection operations of the flat cables.

An operation for establishing a circuit having signal lines and grounding lines with the two straps of flat cables is very troublesome and entails much time and labor and further calls for an increase in the space needed for the connection mechanism. This runs counter to the recent demands for miniaturization and simplification of a device.

SUMMARY OF THE INVENTION

The main object of the present invention is to provide a flat cable connecting system capable of forming different signal lines on one and the other sides of a continuous strap of flat cable without use of two straps of flat cables as required in the prior art and forming grounding lines adjacent to the signal lines, and capable of constructing the desired lines with a connection operation as simple as that heretofore required for attachment of a single connector to the terminal of a single flat cable.

To attain the object described above, according to the present invention, there is provided a system for connecting a multiple core flat cable by pinching the flat cable between a connector cover and a connector substrate having contacts to cause the contacts to pierce through an insulator of the flat cable and, in conjunction therewith, to catch hold of and electrically connect to conductors within the insulator, which system comprises forming in the insulator of the flat cable perforations for dividing the conductors into conductor segments extending in one direction and conductor segments extending in the other direction, and causing the contacts for different signals to catch hold of and connect to the respective conductor segments at terminals of the respective conductors segments on the perforation sides to thereby form different signal lines with the perforations as boundaries.

The aforementioned object, other objects, characteristic features and advantages of the present invention will become apparent from the further description of the invention which is given hereinbelow with reference to the accompanying drawings.

DESCRIPTION OF THE PREFERRED EMBODIMENTS

Figure 1:
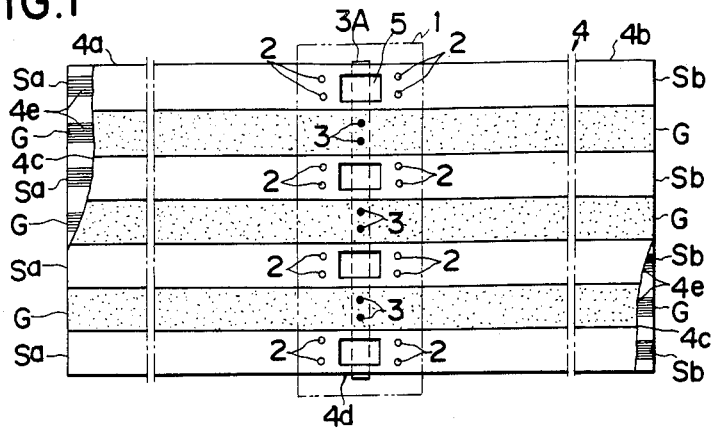
FIG. 1 is an explanatory, schematic plan view showing the relation between a flat cable and contacts of one fundamental embodiment according to the present invention.
Figure 2:
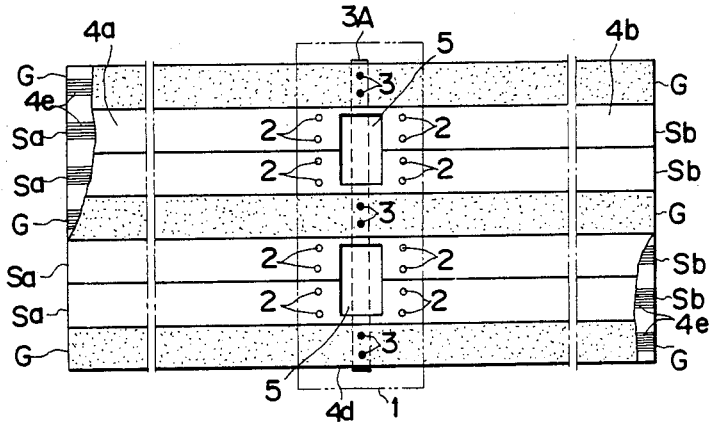
FIG. 2 is an explanatory, schematic plan view showing one modification of the embodiment of FIG. 1.
Figure 3:
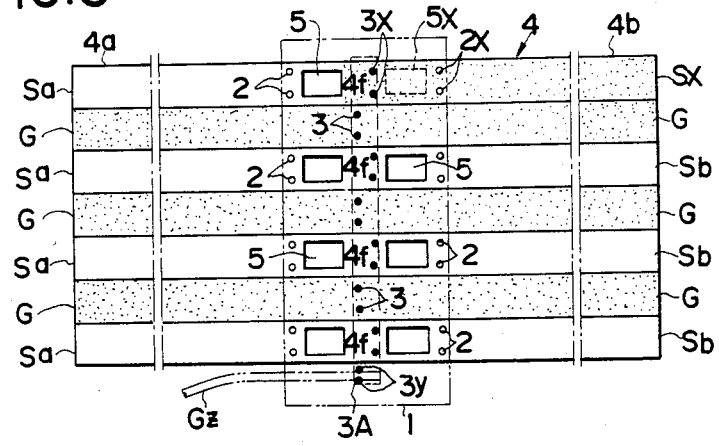
FIG. 3 is an explanatory, schematic plan view showing another modification of the embodiment of FIG. 1.
Figure 4:
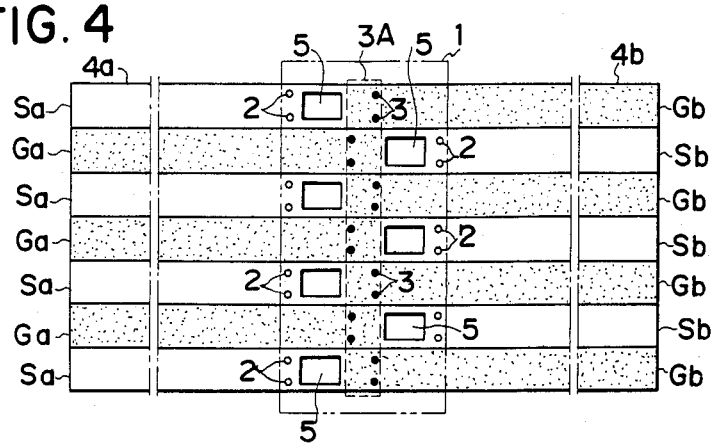
FIG. 4 is an explanatory, schematic plan view showing the relation between a flat cable and contacts of another fundamental embodiment according to the present invention.

FIG. 1 shows one of the fundamental embodiments according to the present invention, in which patterns of perforations, signal lines and grounding lines are formed. FIGS. 2 and 3 show modifications of the fundamental embodiment in FIG. 1. FIG. 4 shows another fundamental embodiment according to the present invention. These Figures and schematically drawn for the purpose of explaining the fundamental ideas of the present invention.

FIGS. 5A through FIG. 5E show one typical example of the idea of FIG. 3 in concrete form to put the flat cable connecting system to practical use and FIG. 8 shows one typical example of the idea of FIG. 4 in concrete form and, therefore, FIGS. 5 to 8 should be referred to in conjunction with FIGS. 1 to 4. In these Figures, the same elements are identified by the same reference numerals.

Reference numeral 1 denotes a connector, 2 contacts for signals provided on the connector, 3 contacts for grounding provided on the connector, and 4 a multiple core flat cable to be connected to the connector. All contacts 3 for grounding are integrally formed with and rise from a common ground bus plate 3A and all contacts 2 for signals are independently mounted on a connector substrate 1a.

To facilitate the understanding of FIG. 1 through FIG. 4, the flat cable 4 is shown to have a small number of cores, the contacts 2 for signals and the contacts 3 for grounding are shown respectively by blank and solid circles, and conductors for grounding are shown by use of stippling to distinguish them from conductors for signal. Concrete constructions of these elements are shown in detail in FIG. 5A et sequentes.

The connector 1 is attached to the flat cable 4 in its connector-fitting area 4*d* midway in the lengthwise direction in any of FIG. 1 through FIG. 4. The flat cable 4 has a number of parallel conductors 4*e* arranged at regular intervals and extended within a strap of insulator 4*c*. The insulator 4*c* of the flat cable 4 has a plurality of openings 5 formed in the connector-fitting area 4*d* to partially or entirely disconnect the conductors.

Figure 10A:
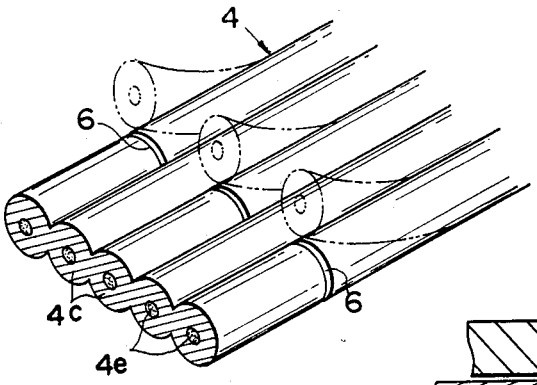
FIGS. 10A and 10B show a flat cable having cut slits, FIG. 10A being an enlarged perspective view showing an example for forming the cut slits in the flat cable and FIG. 10B being a cross-sectional view showing the state of the flat cable attached to the connector.
Figure 10B:
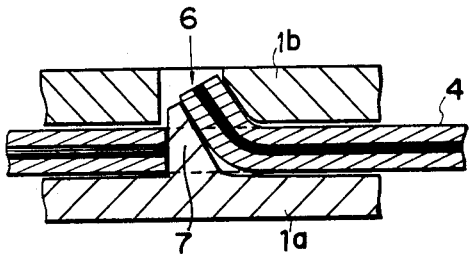
Figure 11:
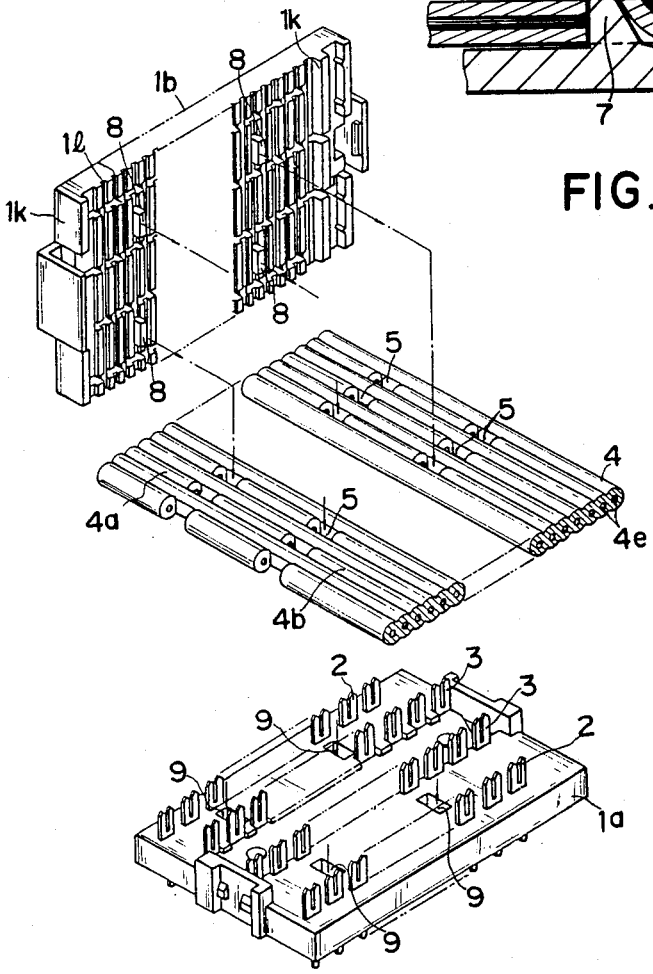
FIG. 11 is an exploded perspective view showing still another embodiment of the present invention, wherein a connector is provided with positioning keys and positioning apertures and is in a state assumed before pressure connection with a multiple core flat cable.
Figure 12:
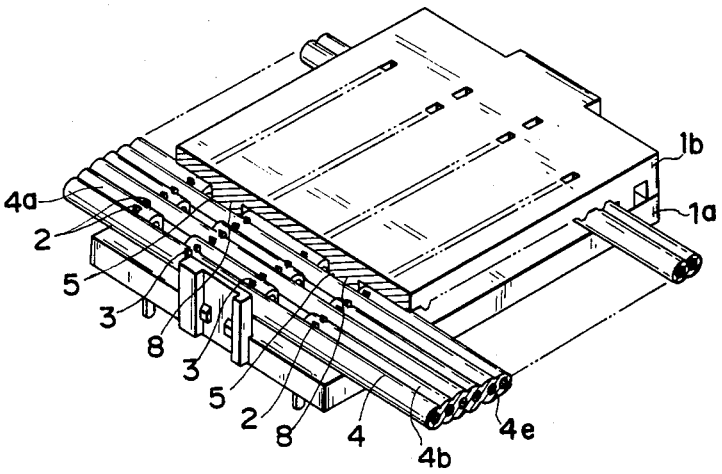
FIG. 12 is a partially cut-away perspective view showing the state assumed when the flat cable has been pinched between the connector cover and the connector substrate of FIG. 11.
Figure 13:
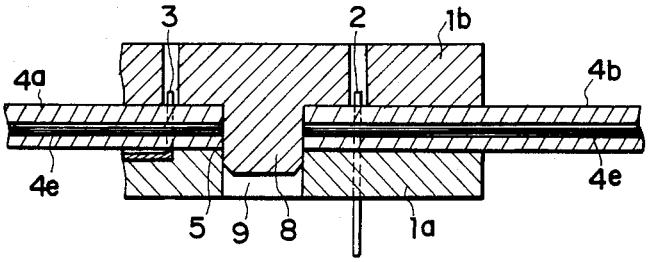
FIG. 13 is a longitudinal cross section showing the connector cover, multiple core flat cable and connector substrate of FIG. 11 in a state assumed when the positioning key of the connector cover has been inserted and fitted in the perforation for dividing the conductor.
Figure 14:
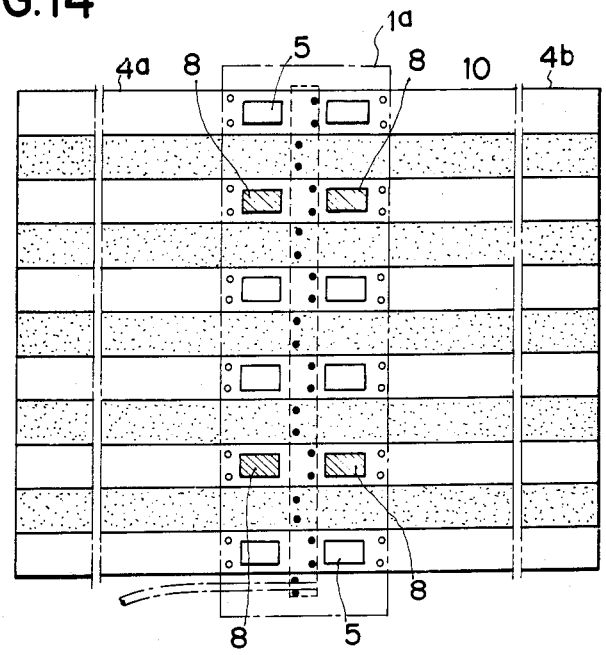
FIG. 14 is a schematical plan view showing a pattern of perforations and the pressure connection state and the key fitting state obtained in accordance with the pattern.

The openings 5 in any of the embodiments described above are formed by cutting out (punching with a press) the insulator 4*c* and the conductors 4*e* in a certain area in the lengthwise direction. Optionally, the perforations may be formed by cutting slits 6 and forcing insulating spacers 7, which rise from the connector substrate 1a or extend down from the connector cover 1*b*, into the cut slits 6 as shown in FIGS. 10A and 10B.

Thus, part or all of the conductors are disconnected at the openings 5 extending through the insulator 4*c* within the insulator 4*c* to divide the conductors into conductor segments 4*a* and conductor segments 4*b* which extend respectively toward one and the other ends of the flat cable 4 with the openings 5 as the centers.

The one directional conductor segments 4*a*, the other directional conductor segments 4*b* and imperforate conductors are caught by and connected to the contacts 2 for signals and/or contacts 3 for grounding of the connector 1 attached to the connector-fitting area 4*d* of the flat cable 4. As a result, two-directional signal lines having conductors Sa and Sb which are separated from each other by the openings 5 developed in the patterns shown in FIGS. 1 to 3 or FIG. 4 are established.

It is thus made possible to form different signal lines on the opposite sides of a signal strap of flat cable 4 and simultaneously to form patterns composed of the conductors Sa for signals and conductors G for grounding which are adjacent to each other on one side and the conductors Sb for signals and conductors G which are adjacent to each other on the other side of the flat cable, and composed of the conductors Sa for signals and conductors Ga for grounding which are adjacent to each other on one side and the conductors Sb for signals and conductors Gb for grounding which are adjacent to each other on the other side of the flat cable, as illustrated in FIGS. 1 to 4.

Figure 9:
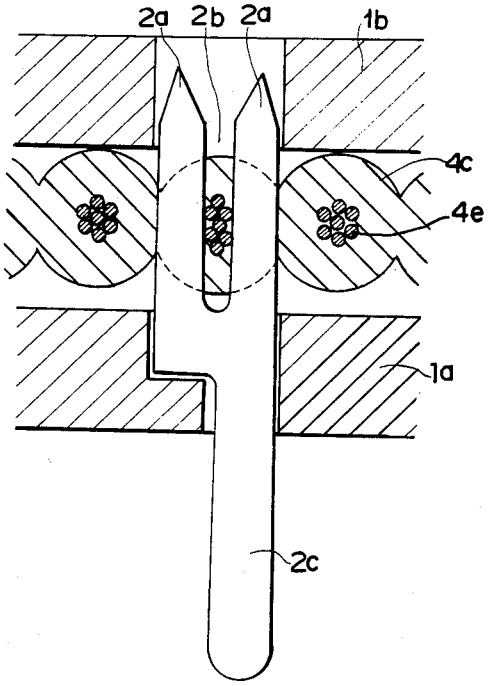
FIG. 9 is an enlarged cross-sectional view showing the construction of a contact for signals in its connected state.

The contacts 2 and 3 for signals and grounding, which have a construction such that they can pierce through the insulator 4*c* and firmly pinch the conductor within the insulator, are used and are spear-like forked contacts as shown in FIG. 9, for example. The contacts 2 and 3 shown respectively by the blank and solid circles in FIGS. 1 to 4 are of such type as the aforementioned spear-like forked contacts.

Each of the contacts 2 for signals comprises at least one pair of parallel prongs 2*a* having sharp leading ends, a U-shaped slot 2*b* defined between the prongs, and a male terminal 2*c* perpendicularly extending downwardly form the lower ends of the prongs 2*a* and being inserted into the connector substrate 1*a* so that the male terminal 2*c* projects downwardly and the prongs 2a project upwardly relative to the connector substrate. Each of the contacts 3 for grounding has at least one pair of prongs 3*a* having sharp leading ends and defines a U-shaped slot 3*b* between the prongs, and the lower ends of the prongs 3*a* of all contacts 3 for grounding are integrally connected to a common ground bus plate 3A which is fitted in the center of the connector substrate 1*a* to allow the prongs 3*a* to project upwardly of the connector substrate. The contacts 2 for signals and the contacts 3 for grounding are thus arranged in series in the patterns as shown in FIGS. 1 to 4.

The aforementioned ground bus plate 3A is firmly attached to the connector substrate 1*a* at a prescribed position by fitting in a concave portion 1*g* formed in the center of the connector substrate between two rows of the contacts 2 for signals in the direction of the width of the flat cable, fitting mounting holes 3*c* in the ground bus plate 3A tightly fitting on projections 1h formed on the bottom wall of the concave portion 1*g* of the connector substrate 1*a*, and rack protuberances 1*i* formed on the right and left side walls of the concave portion 1*g* of the connector substrate 1*a* in the direction of the width of the flat cable at the same pitch as that of the contacts 3 for grounding tightly fitting in the spaces between the adjacent contacts 3 for grounding.

FIG. 15 to FIG. 19 disclose alternate means for firmly attaching the common ground bus plate 3A to the connector substrate 1*a* with ease. At the positions at which some of the aforementioned rack protuberances 1*i* are disposed, i.e. on the side walls of the concave portion 1*g* of the connector substrate, there are formed engaging claws 10*a* which are interposed between the contacts 3 for grounding and engaged with the upper surface of the bus plate 3A at the edges thereof and which are carried on elastically shiftable engaging pieces 10*b* formed integrally with the connector substrate 1*a*. The engaging claw 10*a* projects integrally from the front surface of the engaging piece 10*b* so that it will engage with the upper surface of the edge of the bus plate 3A by utilization of the elastic deformation of shift of the engaging piece 10*b*.

Figure 15:
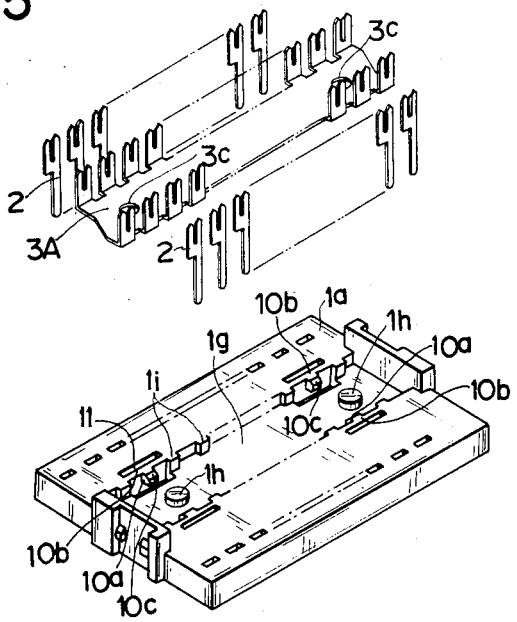
FIG. 15 is an exploded perspective view showing a connector substrate provided with engaging claws for firmly attaching a common ground bus plate thereto.
Figure 16:
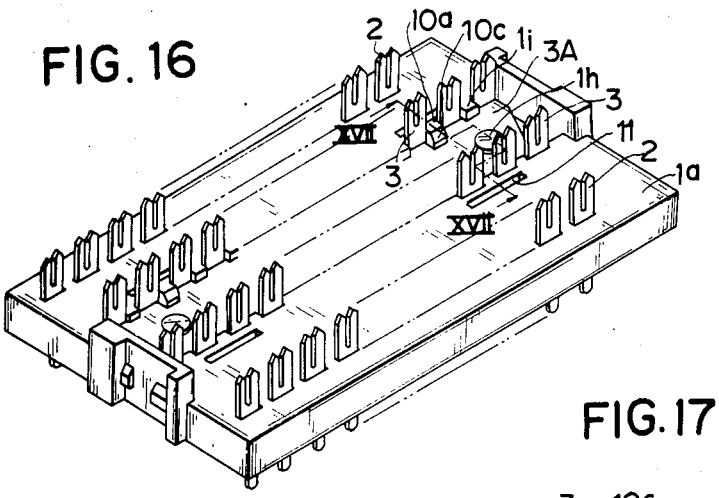
FIG. 16 is a perspective view showing the conductor substrate of FIG. 15 in its assembled state.
Figure 17:
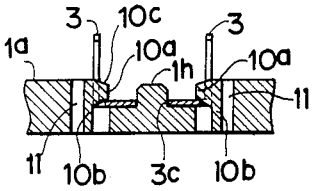
FIG. 17 is a cross-sectional view taken along the line XVII—XVII in FIG. 16.

In the FIG. 15 to FIG. 17, the engaging piece 10*b* is laterally disposed along the side wall of the concave portion 1*g* (in the direction in which the contacts 3 for grounding are arranged in rows) with its opposite ends connected to the connector substrate 1*a* and is provided on the front surface thereof at its center integrally with the projecting engaging claw 10*a* which has a tapered portion 10*c* on the upper surface. The ground bus plate 3A pushes away the tapered portion 10*c* of the engaging claw 10*a* and, at this time, the engaging piece 10*b* is elastically shifted in the backward direction (in the direction against the elasticity) to allow the ground bus plate 3A to be fitted in the concave portion 1*g*. As soon as the ground bus plate 3A has been fitted in the concave portion 1*g*, the engaging piece 10*b* is restored by virtue of its own elasticity to cause the engaging claw 10*a* to be interposed between the contacts 3 and engaged with the upper surface of the edge of the bus plate. The connector substrate 1*a* has oblong holes 11 formed in the portions in front of the behind the engaging pieces 10*b* so as to facilitate the elastic deformation or shift of the engaging pieces 10*b*. The formation of the oblong holes 11 allows the engaging piece 10*b* to be connected to the connector substrate 1*a* at the opposite ends only.

Figure 18:
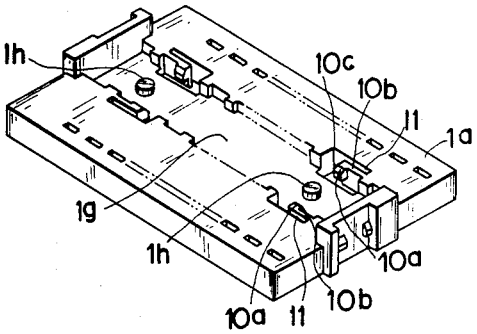
FIG. 18 is a perspective view showing a connector substrate provided with other engaging means for firmly attaching the common ground bus plate thereto.
Figure 19:
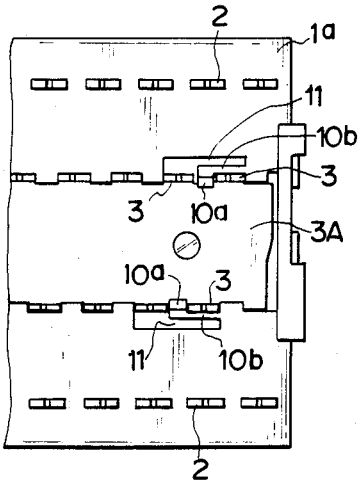
FIG. 19 is a plan view showing the principal part of the connector substrate of FIG. 18 in a state assumed when the common ground bus plate of the contacts for earthing has been attached.

In FIGS. 18 and 19, the engaging piece 10*b* is laterally disposed with one end connected to the connector substrate 1*a* and its other end free and has the engaging claw 10*a* projected from the front surface of the free end, whereby the elastic deformation or shift of the engaging piece and the engagement of the engaging claw with the upper surface of the edge of the ground bus plate can be attained similarly to the embodiment shown in FIGS. 15 to 17.

According to the construction shown in FIGS. 15 to 17 and that shown in FIGS. 18 and 19 adopting the common ground bus plate 3A to which the contacts 3 for grounding are integrally connected, as described above, whereas it would be difficult to form male terminals such as terminals 2*c* of the contacts 2 for signals on the respective contacts 3 for grounding, the common ground bus plate 3A can precisely be fixed with ease at the prescribed position on the connector substrate 1*a* and can be prevented from being laterally shifted, floating and shaking.

Figure 5A:
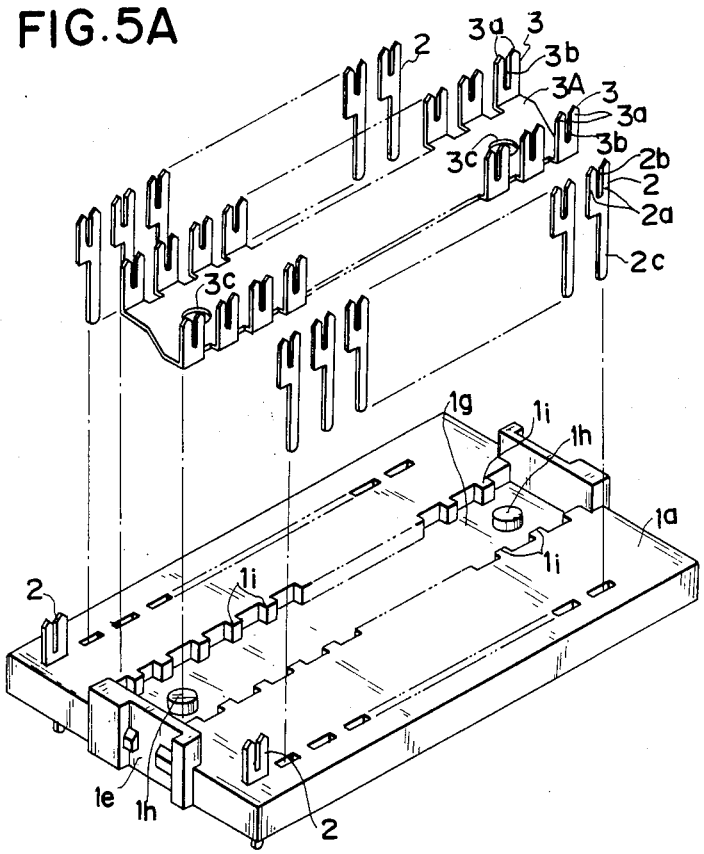
FIGS. 5A, 5B, 5C, 5D, and 5E show one example of the modification of FIG. 4, FIG. 5A being an exploded perspective view of a connector substrate, FIG. 5B being a perspective view of the connector substrate in an assembled state, FIG. 5C being an exploded perspective view showing the connector substrate, a connector cover and a flat cable in a state assumed before assemblage, FIG. 5D being a perspective view showing the connector substrate, connector cover and flat cable in an assembled state, and FIG. 5E being an enlarged perspective view showing the state of connection between the flat cable and the contacts.
Figure 5B:
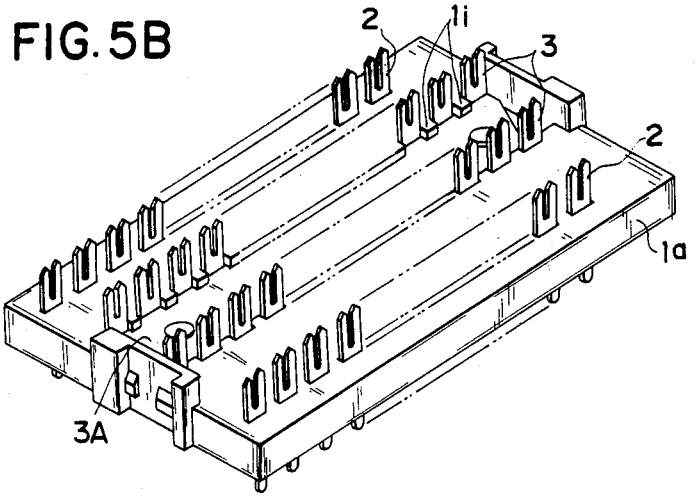
Figure 5C:
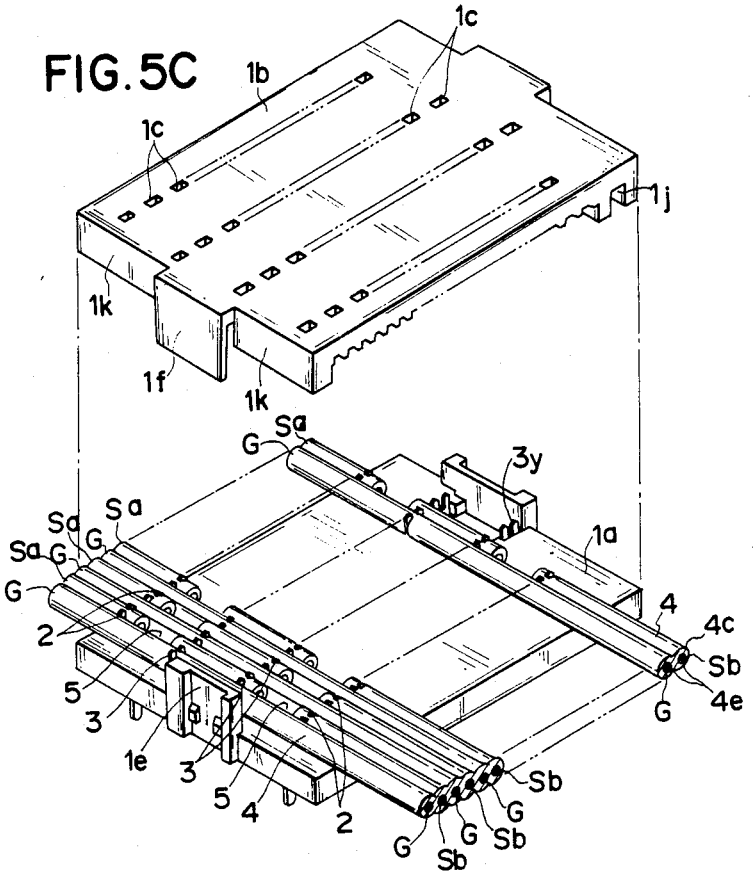
Figure 5D:
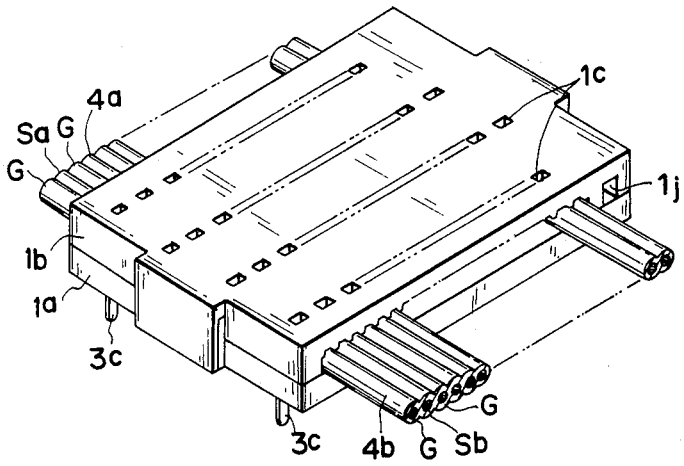
Figure 5E:
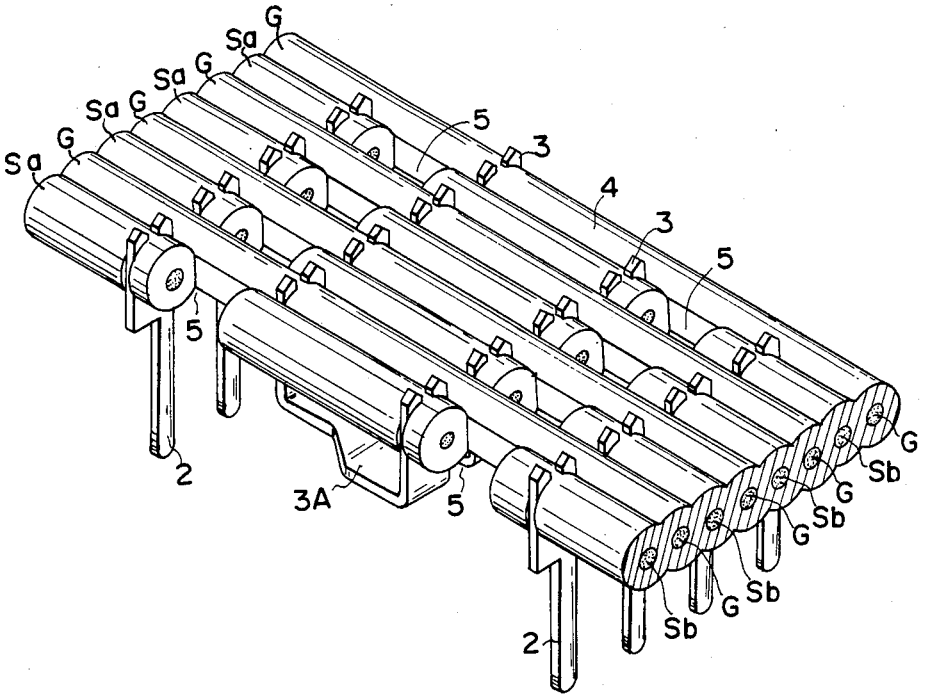
Figure 6:
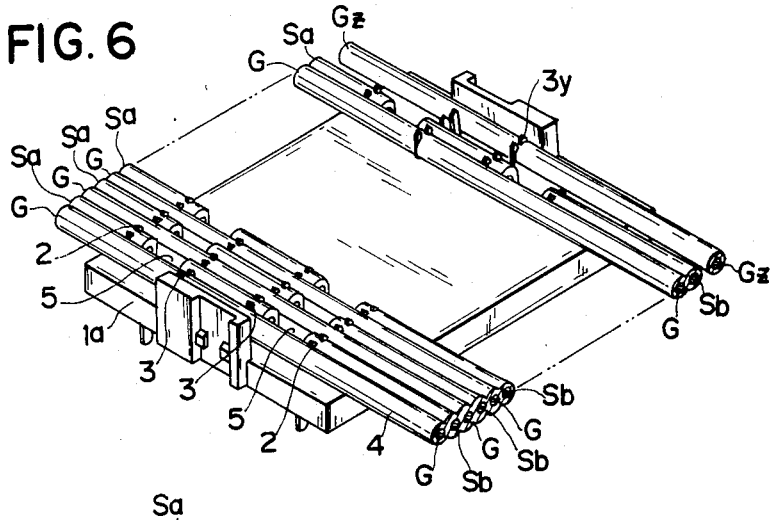
FIG. 6 shows another example of the modification of FIG. 3 and is a perspective view showing a connector and a connection mechanism provided with one common earth bus bar.
Figure 7:
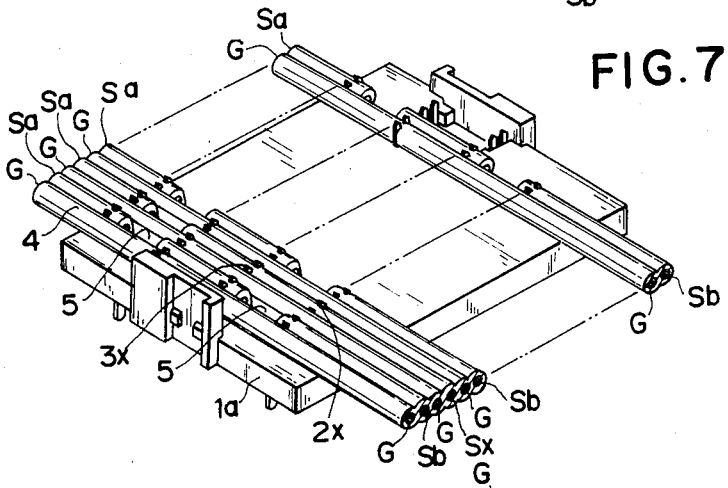
FIG. 7 shows still another example of the modification of FIG. 3 and is a perspective view showing a connector and a connection mechanism provided with another common ground bus bar.

The connectors and the connecting mechanisms usable in the embodiments shown in FIGS. 1 through 4 will be understood from FIGS. 5 to 7 corresponding to the typical example of FIG. 3 and from FIG. 8 corresponding to a typical example of FIG. 4.

The connector 1 comprises the connector substrate 1*a* having an insulating disc as a matrix and the connector cover 1*b*. When the connector substrate 1*a* and the connector cover 1*b* are assembled into the connector 1 with the flat cable 4 embraced and firmly pinched therebetween, the contacts 2 and 3 pierce through the insulator 4*c* and have their leading ends inserted into contact insertion holes 1*c* bored in the connector cover 1*b* so as to conform to the arrangement of the contacts 2 and 3. In this state, lock means 1*e* provided on the opposite ends of one of the connector substrate 1*a* and the connector cover 1*b* and lock means if provided on the opposite ends of the other are brought into male-to-female engagement with each other at positions outside the opposite lug portions of the flat cable, with the result that the connector substrate 1*a* and the connector cover 1*b* are integrally united with each other. In this manner, the connector 1 is firmly attached to the connector-fitting area 4*d* of the flat cable 4 and the conductors Sa, Sb, G, Ga and Gb for signals and grounding are kept connected to each other.

The aforementioned connecting mechanism for the contacts 2 and 3, connector cover 1*b* and connector substrate 1*a* is only an example and may be modified.

By using the connecting mechanism as described above, preparing a connector which has the contacts 2 and 3 arranged as shown in FIGS. 1 to 4, causing the sharp prongs 2*a* and 3*a* of the contacts 2 and 3 to pierce through the insulator 4*c* of the cable 4, causing the U-shaped slots 2*b* and 3*b* of the contacts 2 and 3 to cause press-in of the catching hold of the conductors Sa and Sb for signals and the conductors G, Ga and Gb for grounding respectively to obtain pressure connection, two-directional signal lines of various patterns as described afterwards can be formed on the opposite ends of the flat cable.

In relation to the aforementioned description, the constructions peculiar to the embodiments shown in FIG. 1 to FIG. 4 will be described. In conjunction therewith, FIGS. 5 to 7 corresponding to the embodiment shown in FIG. 3, and FIG. 8 corresponding to the embodiment shown in FIG. 4 should be referred to.

In the embodiments shown in FIGS. 1 and 3, each of the conductors having one or two openings 5 is disposed between unapertured conductors, with the openings in alignment with one another. In the embodiment shown in FIG. 2, pairs of adjacent apertured conductors are disposed between unapertured conductors with the openings of each of the apertured conductors arranged so that the openings communicate with each other to form a large opening 5. The large openings in the apertured conductors are in alignment with one another. In any of these embodiments, the apertured conductors are used as conductors for signals and the unapertured conductors as conductors for grounding.

To be more specific, in any of the embodiments shown in FIGS. 1 to 3, the conductor is separated across the opening 5 into a conductor segment 4*a* which extends as the conductor Sa for a signal toward one end of the flat cable 4 and a conductor segment 4*b* which extends as the conductor Sb toward the other end of the flat cable 4. The conductor segment 4*a* is caught by and connected with part of one contact 2 for signals which pierces the insulator of the flat cable at the terminal on the one side of the opening to form a one-directional signal line and, at the same time, the conductor segment 4*b* is caught by and connected with part of another contact 2 for signals which pierces the insulator of the flat cable at the terminal on the other side to form the other-directional signal line. Therefore, the contacts 2 for signals are orderly opposed across the openings 5.

Each of the embodiments shown in FIGS. 1 to 3 forms different signal lines on one and the other ends of the flat cable 4 and, at the same time, forms a common grounding line used for both the one-side signal line of the conductors Sa for signals and the other-side signal line of the conductors Sb which are formed on the flat cable 4 by causing each of the unapertured conductors to be adjacent to the opposite sides of each of the conductors Sa and Sb for signals (FIGS. 1 and 3) or to be adjacent to one side of each of the conductors Sa and Sb for signals (FIG. 2), causing the contacts 3 for grounding provided on the connector 1 to pierce the insulator of the unapertured conductors between the openings and causing the contacts 3 to catch hold of and connect with the conductors for grounding. Symbol G denotes a common conductor for grounding constituting the aforementioned grounding line.

The arrangement of the apertured and unapertured conductors described with reference to the embodiments shown in FIGS. 1 to 3 should not be applied to all conductors of the flat cable. Optionally, some of the conductors for signals may be used as a conductor for grounding if the occasion demands. Further, a plurality of aligned openings per conductor may be formed in the conductors of the embodiments shown in FIGS. 1 and 2.

In the connector-fitting area 4*d* having a plurality of openings aligned in the direction of the length of the conductor, one and the other ends of the perforations do not mean any end across which the openings are disposed.

FIG. 3 shows an example of the flat cable connecting system according to the present invention, which involves the fundamental idea of the embodiment shown in FIG. 1, has two openings per-conductor formed in alignment with each other, and will be described hereinafter with reference to FIGS. 5A to 5E, 6 and 7.

As illustrated, openings 5 constituting one group are aligned in the direction of the width of the flat cable and openings 5 constituting the other group are aligned in parallel to the one group of openings. Between the two groups of openings 5 is interposed a ground bus plate 3A from which grounding contacts 3 rise in zigzag arrangement in the direction of the width of the flat cable. The grounding contacts 3 in one row catch hold of and connect the unapertured conductors (grounding conductors G) to form a grounding line and the grounding contacts 3 in the other row catch hold of and connect isolated portions 4*f* of the apertured conductors disposed between the opposed openings 5 and disconnected from both ends of the flat cable. The isolated portions 4 of the apertured conductors in the embodiment of FIG. 3 have nothing to do with formation of either a signal line or a grounding line. This will be better understood from FIG. 5E corresponding to FIG. 3.

When an optional signal conductor, such as a conductor composed of conductor segments Sa and Sx in FIG. 3 or FIG. 7, has a single opening 5 without an opening 5X shown by chain lines in FIG. 3 to allow the conductor segment Sx to extend over the position of a grounding contact 3X and the extended terminal of the conductor segment Sx is caught by and connected with the grounding contact 3X, it is possible to short-circuit the grounding contact 3X and a signal contact 2X. That is to say, all other grounding contacts 3 and all grounding conductors G connected thereto under the application of an electric current by means of the common ground bus plate 3A are connected to the conductor segment Sx (a common ground bus bar) through the grounding contact 3X, with the result that lump ground connection can be obtained through the contact 2X (a common grounding contact) which would be a signal contact if the opening 5X were formed in the conductor segment Sx. Thus, a lump ground connection mechanism can be formed by suitably selecting one of the signal conductors, providing a single opening in the selected conductor to divide it into conductor segments Sa and Sx, and connecting the conductor segment Sx and the grounding contact 3X to utilize the corresponding signal conductor segment and signal contact respectively as a common grounding bus bar and a common grounding contact. Therefore, the grounding contacts 3 arranged in a row on the intrinsically isolated portions 4*f* of the apertured conductors can advantageously be used when the aforementioned lump ground connection is required to be formed. Further, a concrete example of the connector and the connection mechanism adopting the lump ground connection with the selected grounding contact 3X, common grounding contact 2X and common grounding conductor Sx utilized is clearly shown in FIG. 7.

Furthermore, the embodiment shown in FIG. 3 is provided with an auxiliary grounding contact 3*y* which is disposed on the end of the common ground bus plate 3A and not connected to any of the conductors of the flat cable. This auxiliary grounding contact 3*y* is used, as shown in FIG. 6, by connecting the same to a separate conductor Gz as a common ground bus bar to thereby form a lump ground connection for a printed board etc. The common ground bus bar Gz is passed through a path 1*j* formed in the inner surface of the cover 1*b* as shown in FIG. 5D and guided out of the connector. It goes without saying that the auxiliary grounding contact 3*y* may be applied to the embodiment of FIGS. 1, 2 or 4 and that either one or both of the common ground bus bars Gz and Sx may be used, as the occasion demands, in order to form a lump ground connection.

Figure 8A:
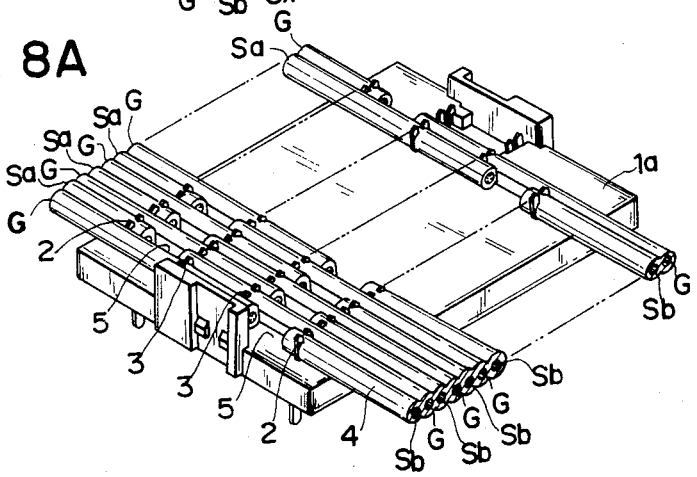
FIGS. 8A and 8B show a modification of the embodiment of FIG. 4, FIG. 8A being a perspective view showing a connector and a connection mechanism and FIG. 8B being an enlarged perspective view showing the state of connection between the flat cable and the contacts.
Figure 8B:
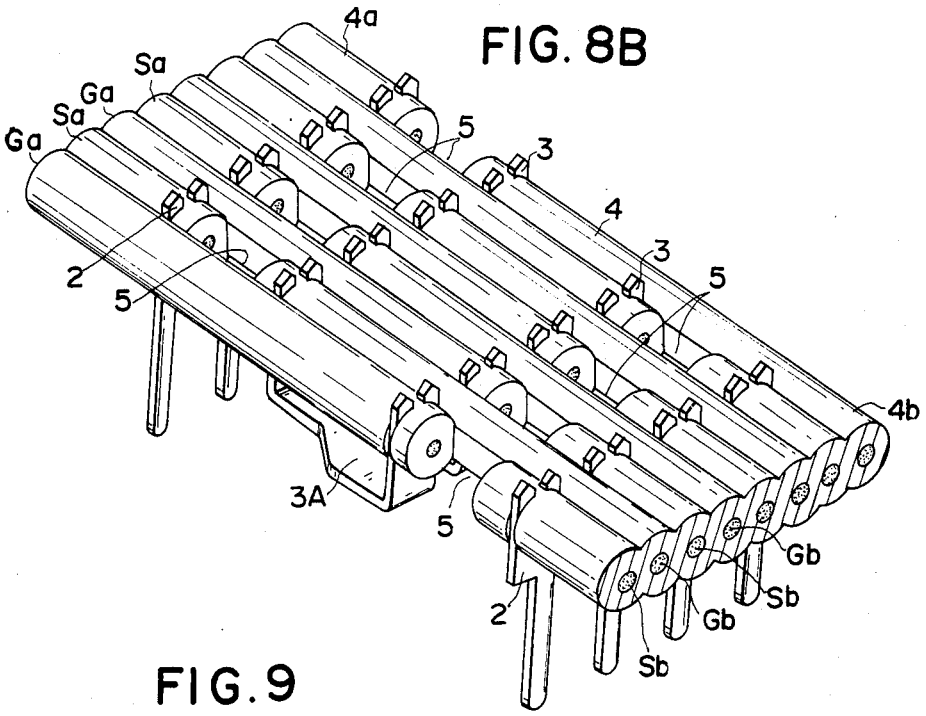

The construction peculiar to the embodiment schematically shown in FIG. 4 will be described with reference to the connector and connection mechanism shown in corresponding FIGS. 8A and 8B.

In FIG. 4, a plurality of adjacent conductors are each provided with one opening 5, whereby the same object as that of the embodiment shown in FIG. 3 is attained.

To be specific, the openings 5 in the adjacent conductors are shifted in position in the direction of the length of the conductors so as not to be exactly opposed to each other and the openings 5 form as a whole a zigzag arrangement. Each of the openings divides the conductor 4*e* into a conductor segment Sa or Ga and a conductor segment Gb or Sb. This embodiment differs from the embodiments shown in FIGS. 1 to 3 in the aspect that this embodiment has all the conductors therein apertured. One of the adjacent conductors is divided by the opening 5 into the conductor segments Sa and Gb, and the conductor segment Sa on the left hand in FIG. 4 is caught by and connected with a signal contact 2 and the conductor segment Gb on the right hand in FIG. 4 is caught by and connected with a grounding contact 3, whereas the other of the adjacent conductors is also divided by the opening 5 into the conductor segments Ga and Sb, and the conductor segment Ga on the left hand in FIG. 4 is caught by and connected with a grounding contact 3 and the conductor segment Sb on the right hand in FIG. 4 is caught by the connected with a signal contact 2. That is to say, the conductor segments Sa and Ga on the left hand and the conductor segments Gb and Sb on the right hand in FIG. 4 are respectively arranged alternately in the direction of the width of the flat cable.

With the arrangement described above, different signal lines are formed on one and the other sides of the flat cable 4 and by the opening 5 with the connector-fitting area as the boundary and simultaneously grounding lines adjacent to the signal lines are formed on both ends of the flat cable 4. In other words, the one-directional signal line and the other-directional signal line, which are formed on one conductor in the embodiments shown in FIGS. 1 to 3, are formed on the adjacent conductors in an alternate manner. The grounding conductors are similarly arranged.

It is noted that in the embodiment of FIG. 4 the arrangement patterns of the signal and grounding contacts 2 and 3 correspond to those of the singal and grounding conductors. Similarly to the embodiment of FIG. 3, an unapertured signal conductor is adopted in the embodiment of FIG. 4 to thereby enable the unapertured conductor to be used as a common ground bus bar and a signal contact connected with the unapertured conductor to be used as a common ground contact.

The connection system shown in FIG. 8 corresponding to FIG. 4 is the same as that shown in FIGS. 5 to 7 corresponding to FIG. 3, except for the arrangement of the signal contacts 2. The pattern of FIG. 4 may be adapted for part or all of the conductors in the flat cable. Further, in the embodiment of FIG. 4, two or more openings 5 may be formed in each of the conductors.

According to the present invention, as described above, it is possible to form two-directional signal lines different from each other on one and the other ends of a single strap of flat cable by attaching a single connector to the midway portion of the flat cable in the direction of the length thereof. The present invention is thus effective when alternate use of the signal conductors and grounding conductors is required.

When the signal and grounding conductors are alternately arranged in a single strap of flat cable according to the prior art system, the number of the signal conductors becomes one-half the total number of the signal conductors becomes one half the total number of the conductors in the flat cable. According to the present invention, however, since it is possible to form alternate signal and grounding lines on each end of a flat cable, the same results as in the case of using all conductors in a strap of flat cable as signal lines can substantially be obtained.

According to the present invention, desired patterns of signal and grounding lines can freely be formed on both ends of a flat cable by combining patterns of openings and corresponding patterns of arrangements of contacts of a connector.

Although it has heretofore been necessary to prepare two straps of flat cables, a single strap of flat cable having a prescribed pattern of openings will suffice in the present invention. This reduces to one half not only the cable cutting work but also the connector connecting work and particularly makes it very easy to position the flat cable relative to the connector and its contacts. In comparison with the case where two straps of flat cables are positioned adjacent each other relative to a single connector, the present invention makes it easier to position a flat cable and a connector relative to each other to thereby ensure the connection between the flat cable and the connector with high accuracy. Further, since the present invention is not a system of dividing a flat cable into two segments but a system of dividing a conductor into two segments, the connector connecting work is very simplified and a highly reliable connection can be obtained.

In the case where two straps of flat cables are used and connected to a connector, when a tension force is exerted on one end of one of the flat cables, the one flat cable is likely to be shifted away from the other flat cable to there-by lower the reliability of connection. In the present invention using a single strap of flat cable, no such adverse phenomenon arises due to relative reinforcement of both ends of the flat cable and, therefore, reliable and stable connection between the flat cable and the connector can be maintained.

The present invention makes it possible to form signal lines and grounding lines adjacently to each other while securing a desired number of signal lines within a small area without either increasing the space on which a connector is installed or requiring complexity of the connection mechanism and, therefore, can advantageously be carried out in completing a number of signal lines with a multiple core flat cable and particularly in forming a circuit capable of preventing occurrence of cross talk or noise between the signal lines.

FIG. 11 through FIG. 14 show still another embodiment of the present invention, which is provided with positioning means for the connector substrate 1a, connector cover 1b and flat cable 4 and will be described hereinafter.

The connector cover 1b is provided with vertical walls 1*k* which are disposed along the lugs of the multiple core flat cable 4 to regulate the width of the flat cable and with conductor-aligning grooves 1*l* which are formed in the inner wall surface (cable attachment surface) between the vertical walls 1*k* at the same pitch as that of the conductors. The conductor-aligning grooves 1l are arranged in parallel to each other to form as a whole a wave. The inner wall of the connector cover 1*b* having therein the conductoraligning grooves 1*l* is provides with projecting keys 8. Preferably, a plurality or projecting keys 8 are formed so as to correspond to the openings 5 and, in pressure contact of the flat cable between the connector cover 1*b* and the connector substrate 1*a*, are inserted into the openings 5 and held in that state after the pressure contact. Since the openings 5 for dividing the conductors 4*e* are rectangular when seen from its top plan view, as illustrated, the projecting keys 8 to be inserted into the openings 5 are preferably formed in a rectangular shape so as to conform to the shape of the openings 5. Each of the projecting keys 8 has at least a height large enough to project downwardly from the lower surface of the flat cable. In a preferred embodiment, the keys 8 pass through the openings 5 in the flat cable 4 and have their respective leading ends engaged in positioning apertures 9 which are bored in the surface of the connector substrate 1*a* from which the contacts 2 and 3 are protrude upwardly. That is to say, the positioning apertures 9 are bored so as to communicate with the openings 5 and admit therein the projecting keys 8. Relative positioning among the connector substrate, connector cover and flat cable can be established when the projecting keys 8 are inserted into the positioning apertures 9 through the openings 5. Optionally, the keys 8 may be formed to be tightly fitted in the positioning apertures 9, thereby integrally uniting the connector substrate and the connector cover with each other or may be formed to be hooked in the inner walls of the positioning apertures 9.

It goes without saying that the positioning keys 8 may be omitted from the inner wall surface of the connector cover 1*b* having therein the conductor-aligning grooves 1*l* and instead that such positioning keys 8 may be formed, in place of the positioning apertures 9, on the surface of the connector substrate 1a from which the contacts 2 and 3 project upwardly. In this case, the positioning keys 8 pass through the opening 5 from below the flat cable 4 and are fitted in the conductor-aligning grooves of the connector cover 1*b*.

Even a flat cable having a large width tends to warp at its intermediate portion. Such tendency can be eliminated by inserting and fitting the projecting keys 8 into the openings 5 formed in the intermediate portion of the flat cable, thereby enabling the flat cable in a flattened state to undergo pressure connection. Therefore, the present invention can effectively cope with the tendency of increase in number of cores, i.e. increase in width of a flat cable, and ensure highly reliable pressure connection.

Thus, the present invention functions to indicate the pressure connection position relative to the flat cable, enables the connector to be attached and connected in a proper position, maintains fitting of the keys 8 in the openings 5 after the pressure connection, exhibits a sufficient force against a tension force exerted in the axial direction of the conductors, and can appropriately maintain the pressure connection state.

We claim:

1. A flat cable connecting system comprising:

a multiple conductor flat cable having a plurality of side by side conductors spaced laterally of the cable and embedded in insulation, said cable having a plurality of openings in an area extending transversely across the cable intermediate the ends of the cable, each opening extending through the cable and completely severing at least one conductor for dividing said severed conductors into conductor segments extending in opposite directions along the cable from the opening; and a connector cover on one face of said flat cable and a connector substrate opposed to said connector cover on the opposite face of said flat cable and connected to said cover and having contacts piercing the insulation of said cable and gripping and electrically connecting to the ends of said conductor segments on the opposite ends, relative to the length of said cable, of said openings, whereby the conductor segments can be connected in desired electrical lines across said openings.

2. A flat cable connecting system as claimed in claim 1 in which some of said conductors are signal conductors and the remainder of said conductors are ground conductors, said contacts on said connector substrate which are electrically connected to the signal conductors being individual contacts capable of being connected in desired signal lines, and said contacts on said conductor substrate which are electrically connected to said ground conductors being electrically connected in common.

3. A flat cable connecting system as claimed in claim 2 in which only said signal conductors have openings therein.

4. A flat cable connecting system as claimed in claim 2 in which said connector substrate has a common ground bus to which the individual contacts connected to said ground conductors are connected.

5. A flat cable connecting system as claimed in claim 4 in which said openings are aligned in a row in a direction at right angles to the direction of the length of said cable, and said contacts which are electrically connected to said signal conductors being aligned transversely of said cable and on opposite ends of said openings and said contacts which are electrically connected to said ground conductors being aligned transversely of said cable and on a line which extends across said openings.

6. A flat cable connecting system as claimed in claim 5 in which alternate conductors are signal conductors and the remaining conductors are ground conductors.

7. A flat cable connecting system as claimed in claim 5 in which at least two signal conductors are positioned side by side in said cable, and the conductors between said pairs of side by side signal conductors are ground conductors.

8. A flat cable connecting system as claimed in claim 4 in which there are at least two lines of said openings in a direction at right angles to the direction of the length of said cable, and said contacts which are electrically connected to said signal conductors being aligned transversely of said cable on the outside ends of said openings, and said contacts which are electrically connected to said ground conductors being aligned transversely of said cable and on a line which extends between said openings.

9. A flat cable connecting system as claimed in claim 8 in which there are two openings in at least some of said signal conductors.

10. A flat cable connecting system as claimed in claim 4 in which one of said connectors cover and said connector substrate has projections thereon extending into said openings when said connector cover and said connector substrate are in position on said cable.

11. A flat cable connecting system as claimed in claim 10 in which the other of said connector cover and said connector substrate has recesses therein into which the ends of said projections extend.

12. A flat cable connecting system comprising:

a multiple conductor flat cable having a plurality of side by side conductors spaced laterally of the cable and embedded in insulation, said cable having a plurality of openings in an area extending transversely across the cable intermediate the ends of the cable, each opening extending through the cable and completely severing at least one conductor for dividing said severed conductors into conductor segments extending in opposite directions along the cable from the opening, the openings in some of the cables being in a first line extending transversely across the cable and the openings in other of the cables being in a second line extending transversely across the cable and offset in the direction of the length of the cable from the first line; and a connector cover on one face of said flat cable and a connector substrate opposed to said connector cover on the opposite face of said flat cable and connected to said cover and having contacts piercing the insulation of said cable and gripping and electrically connecting to said conductor segments, some of said contacts being signal contacts and being in at least two rows extending transversely of said cable and lying on the outside of the ends, relative to the length of said cable, of the openings in the respective rows which are remote from the openings in the other row of openings, and others of the contacts being ground contacts and being in at least one row extending transversely of said cable between said lines of openings and being connected to each of the conductors and further being electrically connected in common.

13. A flat cable connecting system as claimed in claim 12 in which one of said connectors cover and said connector substrate has projections thereon extending into said openings when said connector cover and said connector substrate are in position on said cable.

14. A flat cable connecting system as claimed in claim 13 in which the other of said connector cover and said connector substrate has recesses therein into which the ends of said projections extend.

* * * * *